US006712634B1

(12) United States Patent
McClinton

(10) Patent No.: US 6,712,634 B1
(45) Date of Patent: Mar. 30, 2004

(54) MOMENT/BOW REDUCING WEAR PLATE

(75) Inventor: Jeffrey Byron McClinton, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/346,365

(22) Filed: Jan. 17, 2003

(51) Int. Cl.[7] ..... H01R 13/625
(52) U.S. Cl. ..... 439/342; 438/259; 438/268
(58) Field of Search ..... 439/342–259, 439/265, 266, 268

(56) References Cited

U.S. PATENT DOCUMENTS 6,280,224 B1 8/2001 Huang ..... 439/342
6,296,506 B1 * 10/2001 Mizumura et al. ..... 439/342
6,609,926 B1 * 8/2003 Chen et al. ..... 439/342

* cited by examiner

*Primary Examiner*—Truc T Nguyen

(57) ABSTRACT

A socket assembly is provided for receiving electronic packages including a cover and a base slidably engaging one another and movable between open and closed positions. The base includes a contact array. The socket assembly also includes a cam member received by the cover and base. Rotation of the cam member actuates a sliding motion between the cover and base. The socket assembly further includes a load bearing member mounted to one of the cover and base, and a wear plate mounted about the load bearing member. The wear plate has a cam reception hole accepting the cam member. The load bearing member and the cam member are located different distances from the contact array to reduce the moment caused by the sliding motion between the cover and base.

14 Claims, 5 Drawing Sheets

MOMENT/BOW REDUCING WEAR PLATE

BACKGROUND OF THE INVENTION

The present invention generally relates to a socket assembly that is designed to reduce bowing during actuation.

Pin grid array (PGA) sockets are used to accept electronic packages on printed circuit boards. PGA sockets facilitate electrical communication between a large number of pins born on an electronic processor and electrical components to which the PGA sockets are mounted (such as circuit boards). Zero insertion force (ZIF) PGA sockets utilize a cover that is slidably movable on a base between open and closed positions. The sliding movement may be actuated, for example, by a cam that is rotated by a hand tool. The cover has a hole array configured to match a pin array on a processor. Similarly, the base has an array of pin receiving chambers configured to accept the pin array of the processor. The processor is mated to the socket by first placing the processor such that its pins penetrate the holes of the cover. With the cover in the open position, the pins penetrate through the holes of the cover and into the pin receiving chambers of the base but are not electrically connected to the pin receiving chambers of the base. When the cover is slid to the closed position, the pins are electrically connected to the base via the pin receiving chambers.

Because there may be hundreds of pins in the array, moving the cover to the closed position can require a considerable force to move the pins into their fully mated position. This force can cause the socket assembly to bow, resulting in inadequate actuation and/or de-actuation.

FIG. 1 illustrates an example of a prior art socket system 10 with a cam actuation mechanism. The socket system 10 includes a cover 12 slidably mounted to a housing 14. The housing 14 is mounted to a board (not shown) by solderballs 16. The socket system 10 includes a cam 18 that is accepted by both the cover 12 and the housing 14. Rotation of the cam 18 results in the cover 12 moving along direction A relative to the housing 14. The cover 12 moves to the right in FIG. 1 when closed (or actuation) and to the left when opened (or de-actuation). The socket system 10 also includes a housing wear plate 20 that nests in the housing 14 and contacts the cam 18 along a bearing surface of the cam 18 as the cam 18 is rotated, and a cover wear plate 21 that nests in the cover 12 and also contacts the cam 18 along a bearing surface as the cam 18 is rotated. The cam 18 includes an eccentric portion that contacts the cover wear plate 21, causing the cover 12 to move laterally as the cam 18 is rotated.

When the cam 18 is rotated, resultant forces are exerted on the housing 14 from the cam 18 via the housing wear plate 20. When the cover 12 is being actuated, a resultant force occurs at closing push surface 22. When the cover 12 is being de-actuated, a resultant force occurs at opening push surface 24. These resultant forces create a moment about the solderballs 16 at which the housing 14 is mounted. The horizontal portions of the moment arms are the opening moment arm 26 and the closing moment arm 28, and correspond to the opening push surface 24 and closing push surface 22, respectively. The moments caused by the resultant forces cause bowing and deflection along bowing direction B. Further, the resultant forces at the opening push surface 24 can cause wear and cracking at a back edge 30 of the housing 14.

For the socket system 10 illustrated in FIG. 1, closing or actuation causes deflection downward along bowing direction B. In this circumstance, the socket system 10 may be supported by a board to which it is mounted and engagement may be achieved. However, opening or de-actuation causes bowing upward along bowing direction B. Because there is no support available above the socket system 10, the resulting bowing can prevent disengagement of the socket.

A need remains for a socket assembly that overcomes the above-noted and other disadvantages of existing PGA sockets.

BRIEF SUMMARY OF THE INVENTION

At least one preferred embodiment of the present invention is provided including a socket assembly for receiving electronic packages. The socket assembly includes a cover and a base slidably engaging one another and movable between open and closed positions. The base includes a contact array. The socket assembly also includes a cam member received by the cover and base. Rotation of the cam member actuates a sliding motion between the cover and base. The socket assembly also includes a load bearing member mounted to one of the cover and base. The socket assembly further includes a wear plate mounted about the load bearing member. The wear plate has a cam reception hole accepting the cam member. The load bearing member and the cam member are located different distances from the contact array to reduce the moment caused by the sliding motion between the cover and base.

Optionally, the load bearing feature may extend from a wear plate cavity formed in the base. The distance between the cam member and the contact array is greater than the distance between the load bearing member and the contact array. The load bearing member may include an opening push surface and a closing push surface. The opening push surface transmits a resultant force when the cover is moved toward the open position, and the closing push surface transmits a resultant force when the cover is moved toward the closed position.

The load bearing member may include an oblong raised element including an opening push surface and a closing push surface on opposing sides of the load bearing member. The wear plate may include an opening forming an oblong slot accepting the oblong raised element. The opening includes an opening surface contacting the opening push surface of the load bearing member, and a closing surface contacting the closing push surface of the load bearing member.

In accordance with at least one preferred embodiment, a socket assembly is provided including a housing, a cover, a cam pin, and a housing wear plate. The housing includes an array of contacts. The contacts are mountable to a circuit board at a mounting feature. The housing also includes an opening push surface and closing push surface. The cover is slidably mounted to the housing and movable relative to the housing between an actuated and a de-actuated position. The housing includes a pin grid corresponding to the array of contacts. The cam pin is received by the housing and the cover, and rotation of the cam pin moves the cover between the actuated and de-actuated positions. The cam pin is located farther from the array of contacts than the opening and closing push surfaces. The housing wear plate includes a cam reception hole that receives the cam pin. The cam reception hole has a bearing surface that contacts the cam pin. The housing wear plate transfers actuation forces from the cam pin to the opening and closing push surfaces. The housing wear plate cooperates with the opening push surface and the closing push surface to reduce a resultant moment caused by a sliding motion between the cover and the base.

Optionally, the housing may include a load bearing member extending from a housing wear plate cavity that is formed in the housing. The load bearing member includes at least one of the opening push and closing push surfaces. The housing wear plate includes an opening including at least one of the opening and closing surfaces. The opening receives the load bearing member. The opening may extend through the housing wear plate.

In accordance with at least one preferred embodiment, a socket assembly is provided including a housing, a cover, a cam pin, a cover wear plate, and a housing wear plate. The housing includes an array of contacts that are mountable to a circuit board at a mounting feature. The housing also includes a housing wear plate cavity including a load bearing member extending from the housing wear plate cavity. The load bearing member has an opening push surface and a closing push surface. The cover is slidably mounted to the housing and movable between an actuated and de-actuated position. The cover includes a pin grid corresponding to the array of contacts. The housing and the cover receive the cam pin, and rotation of the cam pin actuates the housing between the actuated and the de-actuated positions. The cam pin is located further from the mounting feature than the opening and closing push surfaces. The cover wear plate is received by the cover and includes a cam reception hole having a bearing surface that contacts the cam pin. The cover wear plate cooperates with the cam pin to transmit resultant forces from the movement of the cover from the cover to the cam pin. The housing wear plate is received by the housing wear plate cavity and has a cam reception hole that receives the cam pin. The cam reception hole has a bearing surface that contacts the cam pin. The housing wear plate includes an opening that includes an opening surface corresponding to the opening push surface of the load bearing member, and a closing surface corresponding to the closing push surface of the load bearing member. The opening receives the load bearing member. The opening and closing surfaces cooperate with the opening push and closing push surfaces, respectively, to reduce the resultant moment cause by the sliding motion between the cover and the base.

Certain embodiments of the present invention thus provide a socket assembly that reduces bowing and improves actuation and de-actuation effectiveness. Certain embodiments of the present invention also provide a socket assembly that reduces wear, damage, and cracking to components of the socket assembly.

Figure 1:
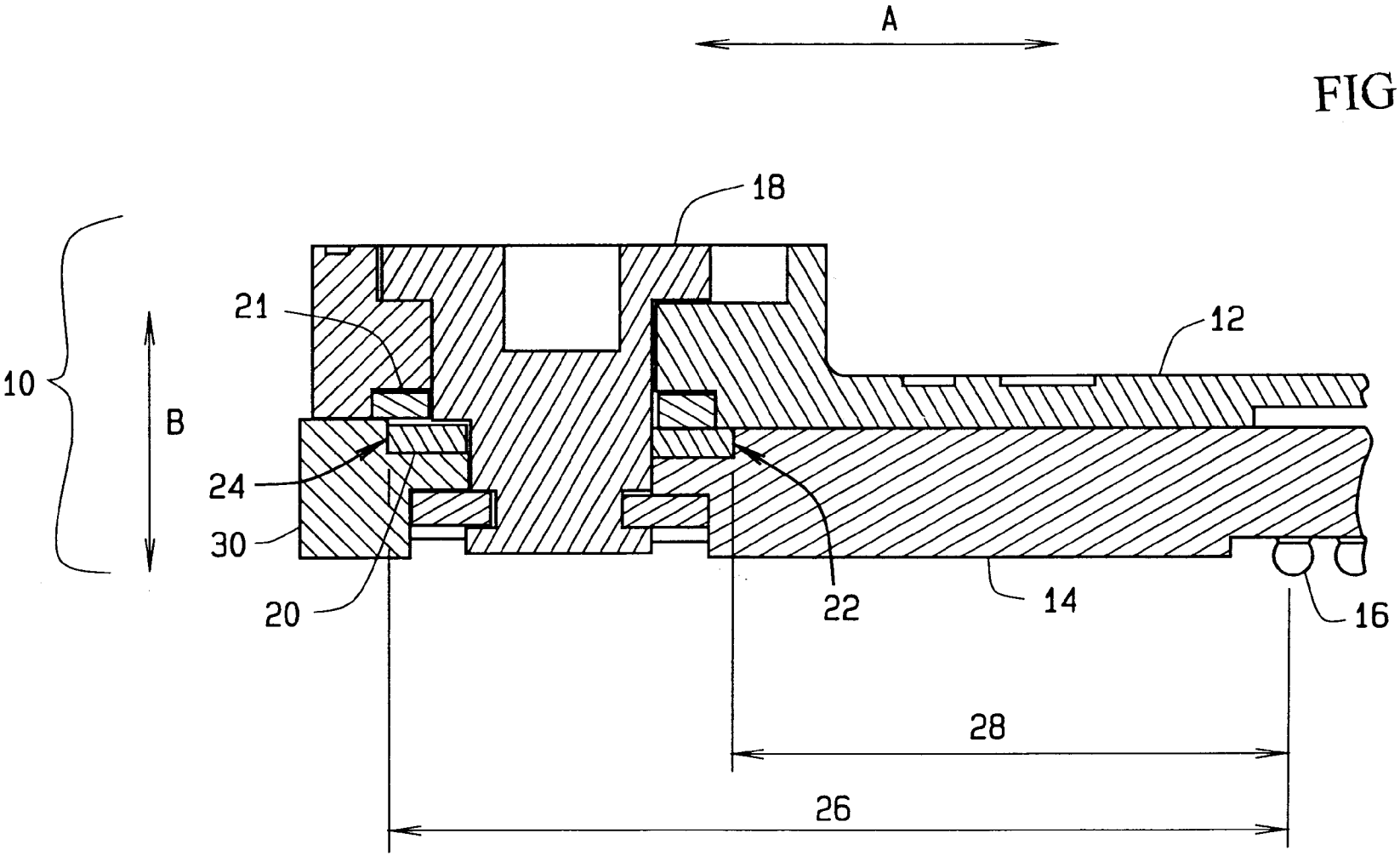
FIG. 1 illustrates an example of a prior art socket system 10 with a cam actuation mechanism.

The foregoing summary, as well as the following detailed description of the preferred embodiments of the present invention, will be better understood when read in conjunction with the appended drawings. For the purpose of illustrating the invention, there is shown in the drawings, embodiments which are presently preferred. It should be understood, however, that the present invention is not limited to the precise arrangements and instrumentality shown in the attached drawings.

DETAILED DESCRIPTION OF THE INVENTION

Figure 2:
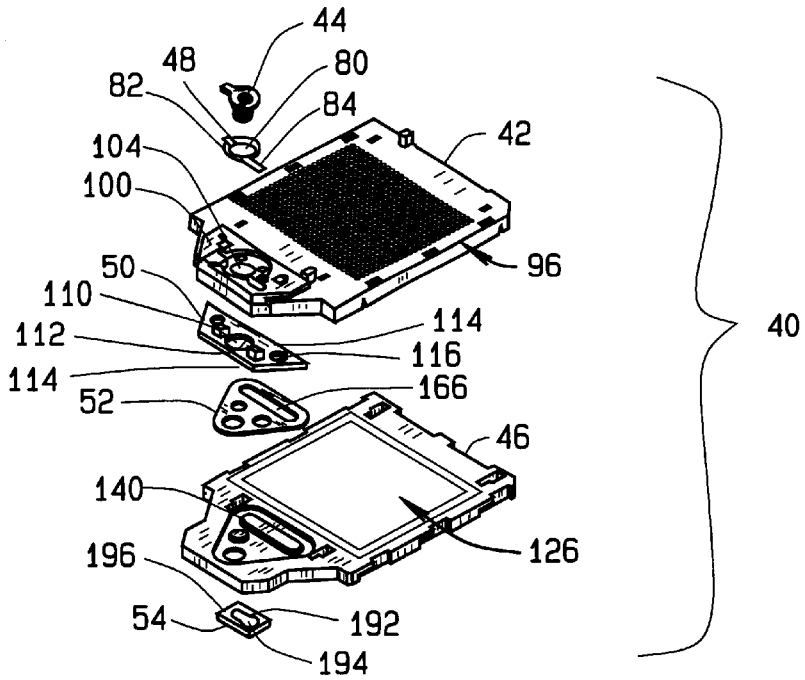
FIG. 2 illustrates an exploded view of a PGA socket assembly formed in accordance with an embodiment of the present invention.
Figure 3:
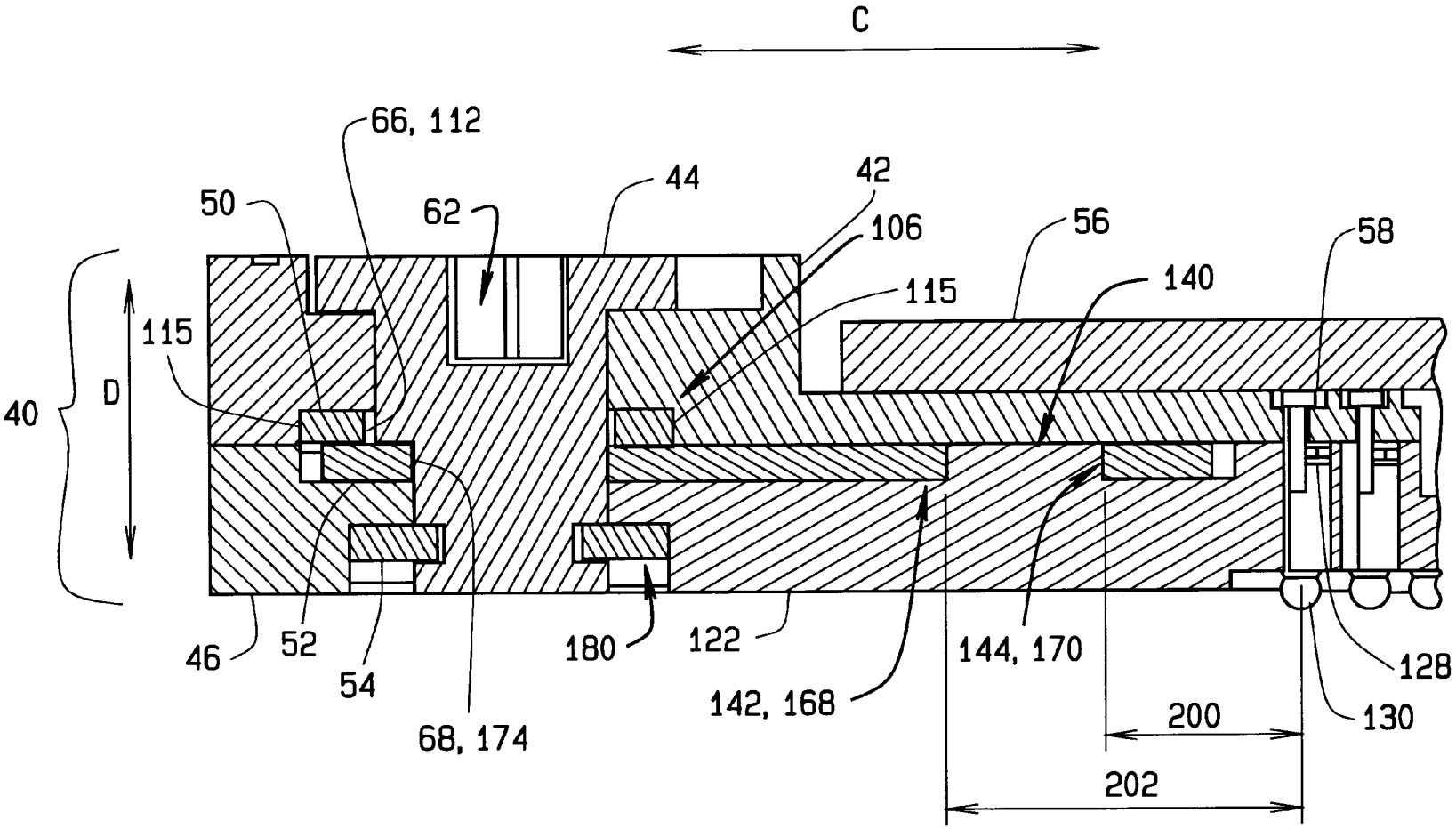
FIG. 3 illustrates a sectional view of a PGA socket assembly formed in accordance with an embodiment of the present invention in an open, or de-actuated position.

FIG. 2 illustrates an exploded view of an embodiment of a PGA socket assembly 40, and FIG. 3 illustrates a sectional view of the socket assembly 40 in an open, or de-actuated position. The socket assembly 40 includes a cover 42, a cam pin 44, and a housing, or base, 46. The cover 42 and housing 46 are socket halves. The cover 42 slidably engages the housing 46. The cam pin 44 is rotatable, and rotation of the cam pin 44 actuates the sliding movement of the cover 42 on the housing 46. Interposed between the cam 44 and the cover 42 is an indicator 48 that indicates whether the socket assembly 40 is actuated or de-actuated. An example of such an indicator is more fully described in U.S. patent application Ser. No. 10/113,540, filed Apr. 1, 2002.

The cam pin 44 is made out of metal, while the cover 42 and housing 46 are made out of plastic. If the cam pin 44 were in direct contact with either the cover 42 or the housing 46, the cam pin 44 could wear or damage the plastic surfaces. Instead, the socket assembly 40 includes a cover wear plate 50 and a housing wear plate 52, each made out of metal. The cover wear plate 50 nests in the cover 42 and accepts the cam pin 44. Similarly, the housing wear plate 52 nests in the housing 46 and accepts the cam pin 44. The socket assembly 40 further includes a retaining plate 54 that retains the cam pin 44 in the socket assembly 40.

As illustrated in FIG. 3, the socket assembly 40 also includes an interposer 56 having pins 58. The interposer 56 is mounted to and in electrical communication with a processor (not shown). The interposer 56 rides on top of the cover 42, and the pins 58 of the interposer 56 are accepted by a pin grid 96 (FIG. 2) of the cover 42, which correspond to a contact array 126 (FIG. 2) of contacts 128 (FIG. 3) of the housing 46. In FIG. 3, the cover 42 is shown in an open position, meaning that the socket assembly 40 is de-actuated. In the open position, the pins 58 of the interposer 56 penetrate through the pin grid 96 of the cover 42 and into the contact array 126 of the housing 46, but the pins 58 are not in electrical communication with the contacts 128. Moving the cover 42 (and the interposer along with the cover 42) to the right along opening/closing direction C results in the pins 56 being brought into electrical contact with the contacts 128. Similarly, moving the cover 42 to the left along opening/closing direction C terminates the electrical communication between the pins 58 and the contacts 128.

Figure 4:
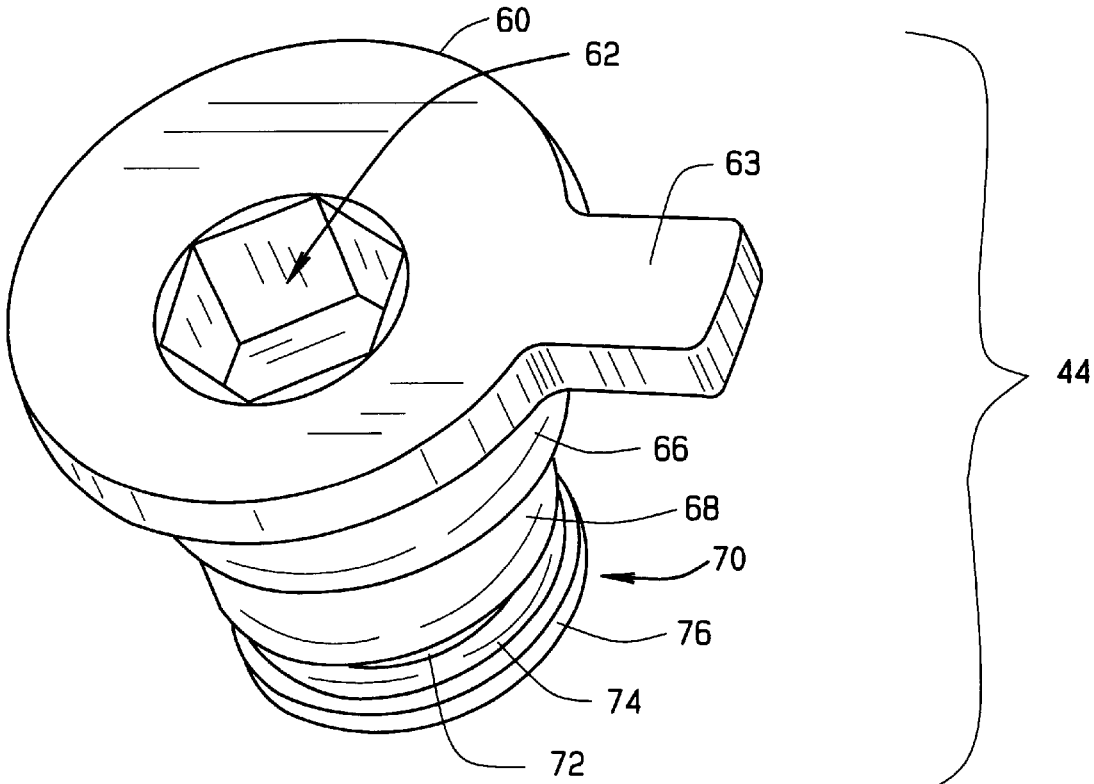
FIG. 4 illustrates a perspective view of a cam pin formed in accordance with an embodiment of the present invention.
Figure 5:
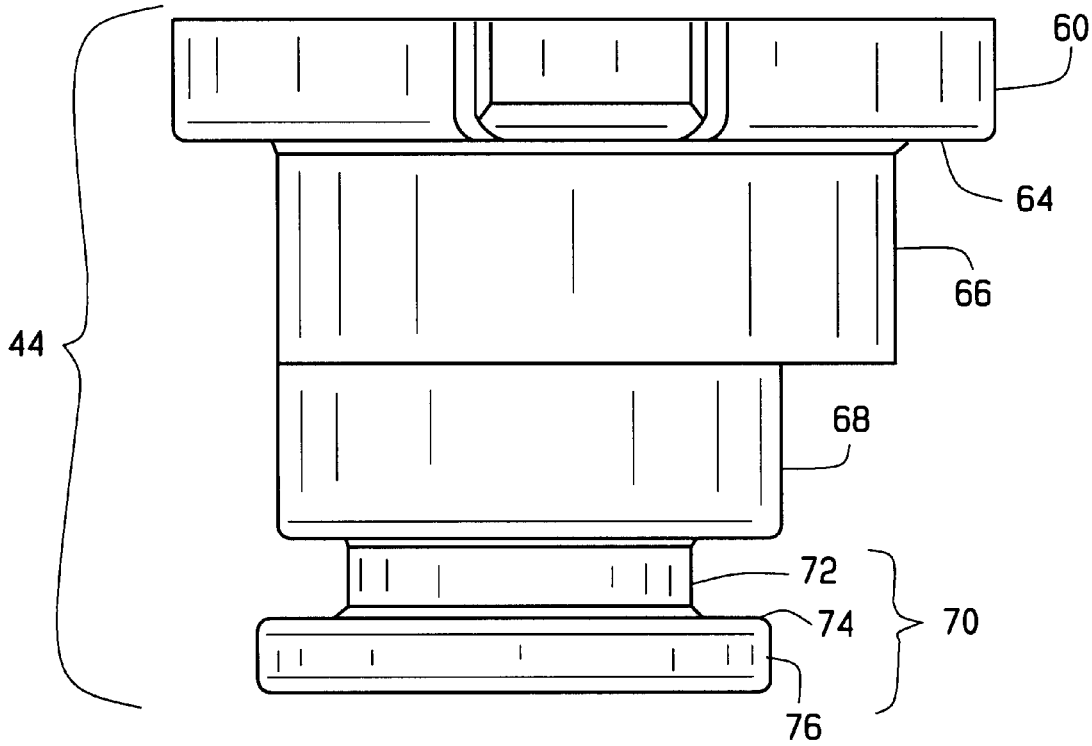
FIG. 5 illustrates an elevation view of the cam pin of FIG. 4.

FIG. 4 illustrates a perspective view of the cam pin 44, and FIG. 5 illustrates an elevation view of the cam pin 44. The cam pin 44 includes a top portion 60, a cover portion 66, a housing portion 68, and a bottom portion 70. The top portion 60 adjoins the cover portion 66, the cover portion 66 adjoins the housing portion 68, and the housing portion 68 adjoins the bottom portion 70. Further, the top portion 60, the housing portion 68, and the bottom portion 70 are all concentric with one another. The cover portion 66 is eccentric with respect to the other portions.

The top portion 60 includes a hexagonal socket 62. The hexagonal socket 62 is sunken into the top portion 60 and accepts a hexagonal head wrench to facilitate actuation. Additionally, the top portion 60 also includes a tab 63 extending laterally from the top portion 60. The top portion 60 terminates at a top lip 64 that extends inward laterally to meet the cover portion 66.

The cover portion 66 is eccentric to the other portions, and is sized to be accepted by the cover wear plate 50. The cover portion 66 is joined to the housing portion 68. The housing portion 68 is cylindrical and concentric with the top portion 66, and is accepted by the housing wear plate 52. The housing portion 68 is joined to the bottom portion 70.

The bottom portion 70 of the cam pin 44 includes a retention lobe 72, a retention lip 74, and a bottom lobe 76. The diameter of the retention lobe 72 is less than the diameter of the housing portion 68, and less than the diameter of the bottom lobe 76. The retention lip 74 joins the retention lobe 72 to the bottom lobe 76.

Figure 6:
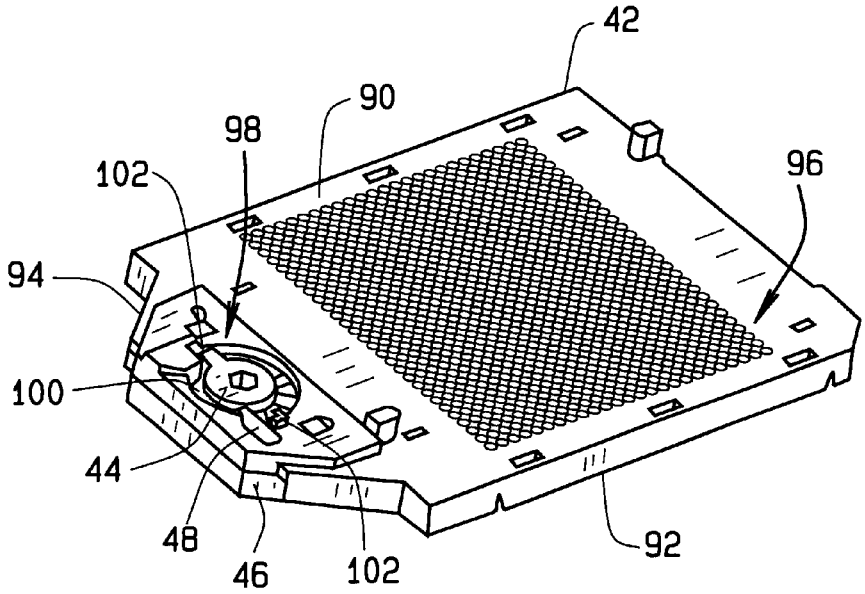
FIG. 6 illustrates a perspective view of a cover formed in accordance with an embodiment of the present invention with a cam and an indicator in place.

FIG. 6 illustrates a perspective view of the cover 42 with the cam 44 and the indicator 48 in place. The cover 42 is slidably mounted to the housing 46. The cover 42 includes a top portion 90, a bottom portion 92, and a back portion 94. The cover 42 includes a pin grid 96 of openings extending from the top portion 90 through the bottom portion 92. The pin rid 96 corresponds to the arrangement of pins 58 of the interposer 56 as well as to the contact array 126 of the housing 46. The cover also includes a cam reception hole 104 (see FIG. 2) extending from the top portion 90 through the bottom portion 92 through which the cam pin 44 extends.

The cover 42 also includes a cam recess 98 extending into the top portion 90 proximal to the back portion 94. The cam recess 98 accepts the cam pin 44 and the indicator 48. The cam recess 98 includes a cam shelf 100 upon which the cam pin 44 and indicator 48 rest when the ring 82 of the indicator 48 abuts the cam shelf 100. The top portion 90 of the cover 42 also includes positive stops 102 that cooperate with the tab 63 of the cam pin 44 to limit the range of rotation of the cam pin 44 to approximately 180° to prevent the cam pin 44 from rotating beyond the actuated or de-actuated positions.

With reference to FIGS. 2 and 6, the indicator 48 includes a through hole 80, a ring 82, and an arm 84. The through hole 80 accepts the cam pin 44, and the indicator 48 is interposed between the cam pin 44 and the cover 42 such that the top lip 64 of the cam pin 44 abuts the ring 82 which abuts the cam shelf 100 of the cover 42. The indicator 48 moves between an actuated and a de-actuated position when the cam pin 44 is rotated so that the position of the arm 48 provides a visual cue as to the position of the cam pin 44, thus indicating whether the socket assembly 40 is in an actuated or de-actuated position.

With reference to FIGS. 2 and 3, the cover 42 includes a recess 106 that extends into the bottom portion 92 of the cover 42 and accepts the cover wear plate 50. The cover wear plate 50 nests snugly into the wear plate recess 106 so that it will not rotate along with the cam pin 44 when the cam pin 44 is actuated. The cover wear plate includes an oblong cam reception hole 110 that accepts the cover portion 66 of the cam pin 44 with minimal clearance. The inside of the oblong cam reception hole 110 is defined by a bearing surface 112 that contacts the outer surface of the cover portion 66 of the cam pin 44. Further, the cover wear plate 50 also includes push surfaces 114 that contact corresponding push surfaces 115 (see FIG. 3) of the wear plate recess 106 to transmit a sliding force caused by rotation of the cam pin 44 to move the cover 42. The cover wear plate 50 also includes void holes 116 to reduce weight.

Figure 7:
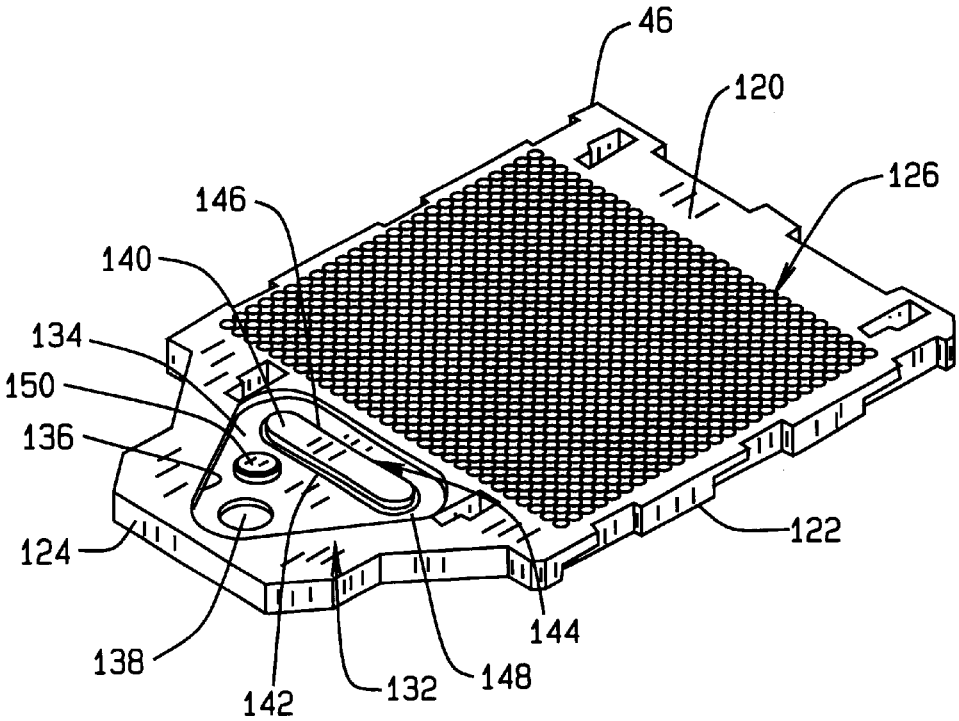
FIG. 7 illustrates a perspective view of a housing formed in accordance with an embodiment of the present invention.

As previously mentioned, the cover 42 is slidably mounted to the housing 46. FIG. 7 illustrates a perspective view of the housing 46. The housing 46 includes a top portion 120, a bottom portion 122, and a back portion 124. The housing 46 includes a contact array 126 corresponding to the array of pins 58 on the interposer 56 as well as the pin grid 96 of the cover 42. The contact array 126 includes individual contacts 128 terminating in solderballs 130 proximal to the bottom portion 122. The contacts 128 typically contain a fork, or fingers, (not shown) such that the pins 58 may be advanced into the fingers to electrically communicate with the contacts 128, and retracted out of the fingers to terminate the electrical communication. The solderballs 130 are soldered to a board (not shown), thereby providing a mounting feature and facilitating electrical communication between components connected to the interposer 56 and the board.

Proximal to the back portion 124, the housing 46 includes a wear plate cavity 132 recessed into the top portion 120. The wear plate cavity 132 houses the housing wear plate 52. The wear plate cavity 132 is defined by a cavity base 134 and cavity sides 136. The housing 46 also includes a cam reception hole 138 penetrating through the wear plate cavity 132, through which the cam pin 44 passes.

The wear plate cavity 132 includes a load bearing feature 140. The load bearing feature 140 is an oblong projection extending upward from the cavity base 134. The load bearing feature 140 is located nearer to the contact array 126 than the cam reception hole 138 is to the contact array 126. The load bearing feature 140 includes an opening push surface 142 and a closing push surface 144, which as a result are also nearer to the contact array 126 than the cam reception hole 138 is. Consequently, the opening and closing push surfaces 142, 144 of the housing 46 are closer to the solderballs 130 of the socket assembly 40 than the closing and opening push surfaces 22, 24 are to the solderballs 16 of the prior art system 10. This results in a reduced moment arm and reduced bowing. The load bearing feature 140 also includes cuts 146 sunk into the closing push surface 144 to control the location of force transmission to the load bearing feature 140 along the closing push surface 144.

The wear plate cavity 132 also includes a recess 148 surrounding the area where the load bearing feature 140 meets the cavity base 134. The recess 148 extends below the cavity base 134 and insures that there are no radii surrounding the junction of the load bearing feature 140 and the cavity base 134 that would prevent the housing wear plate 52 from resting flat on the cavity base 134 of the wear plate cavity 132 of the housing 46. The wear plate cavity 132 further includes a keying feature 150 extending upward from the cavity base 134 that helps properly align the housing wear plate 52 in the wear plate cavity 132.

Figure 8:
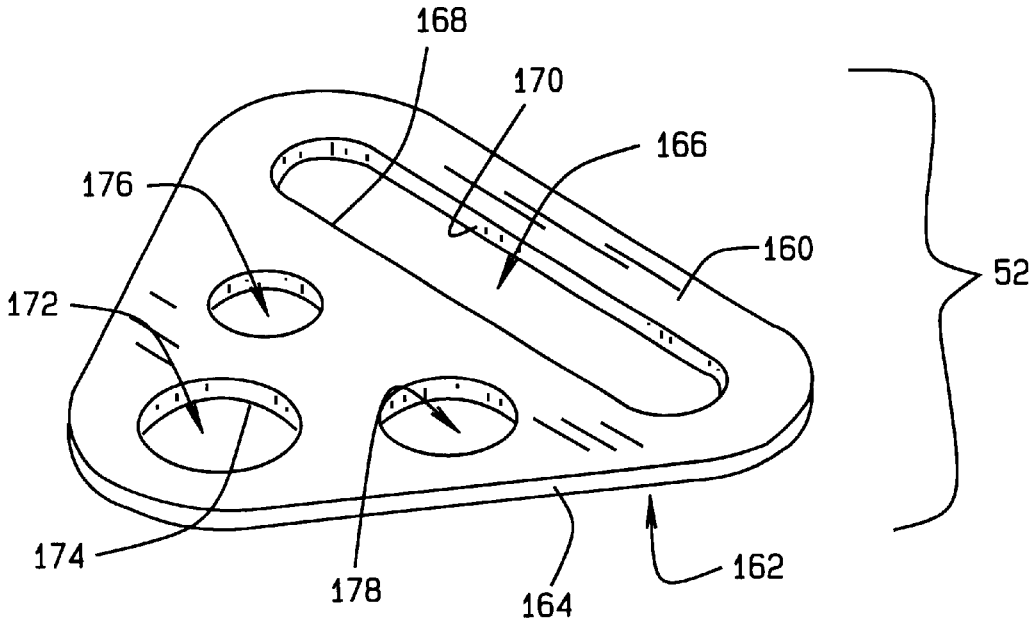
FIG. 8 illustrates a perspective view of a housing wear plate formed in accordance with an embodiment of the present invention.

FIG. 8 illustrates a perspective view of the housing wear plate 52. The housing wear plate 52 includes a top portion 160 and a bottom portion 162 joined by sides 164, and is sized to be accepted by the wear plate cavity 132 of the housing 46. The housing wear plate 52 includes a slot 166 extending from the top portion 160 through the bottom portion 162. The slot 166 is oblong and snugly accepts the load bearing feature 140 of the housing 46. The slot 166 includes an opening surface 168 and a closing surface 170 that correspond to the opening push surface 142 and the closing push surface 144, respectively, of the housing 46. The opening surface 168 and closing surface 170 cooperate with the opening push surface 142 and the closing push surface 144, respectively, to transmit resultant forces from the movement of the cover 42 from the cam pin 44 to the housing 46.

Extending through the housing wear plate 52 is a cam reception hole 172 that accepts the cam pin 44. The interior of the cam reception hole 172 is defined by a bearing surface 174. The bearing surface 174 contacts the outer surface of the housing portion 68 of the cam pin 44. Also extending through the housing wear plate 52 is a keying hole 176. The keying hole 176 accepts the keying feature 150 of the wear plate cavity 132 of the housing 46. When the housing wear plate is manufactured, a burr can be created on the top portion 160. The keying hole 176 and. keying feature 150, which are located laterally off center of the cover wear plate 52, cooperate to ensure that the housing wear plate 52 is placed in the wear plate cavity 132 with the burr side up, or facing the cover wear plate 50 (which is made of metal) instead of the cavity base 134 (which is made of plastic). The housing wear plate 52 also includes a void hole 178. The void hole 178 reduces the overall weight of the housing wear plate 52 and the socket assembly 40. The void hole 178 is sized and configured so that it will not accept the keying feature 150.

Referring to FIG. 2, the socket assembly 40 also includes a retaining plate 54 that acts to retain the cam pin 44 in place. The retaining plate is accepted by a retaining plate cavity 180 (see FIG. 3) that extends into the bottom portion 122 of the housing 46. The retaining plate 54 includes a slot 192 that has a first width 194 and a second width 196. The first width 194 is greater than the diameter of the bottom lobe 76 of the cam pin 44, and the second width 196 is greater than the diameter of the retention lobe 78 but less than the diameter of the bottom lobe 76. Thus, when the slot 192 is aligned such that the first width 194 aligns with the bottom lobe 76, the cam pin 44 may be lowered into the socket assembly until the retaining plate 54 surrounds the retention lobe 72. With the retaining plate 54 and cam pin 44 thus aligned, the retaining plate 54 may be slid laterally with respect to the cam pin 44 so that the second width 196 surrounds the retention lobe 72 of the cam pin 44. Because the second width 196 is less than the diameter of the bottom lobe 76, any attempts to remove the cam pin 44 from the socket assembly 44 will be prevented by the interaction of the retention lip 74, the retaining plate 54, and the retaining plate cavity 180 of the housing 46.

FIG. 3 illustrates the socket assembly 40 in an open, or de-actuated position. The pins 58 have been accepted by the contact array 126, but are not in electrical communication with the individual contacts 128. For the pins 58 to achieve electrical communication with the contacts 128, the cover must be moved to the right along opening/closing direction C.

This movement is accomplished by rotation of the cam pin 44. An operator places a hexagonal wrench in the hexagonal socket 62 and rotates the cam pin 44. As the cam pin 44 rotates, the cover portion 66 of the cam pin 44 presses against the bearing surface 112 of the cover wear plate 50 and the housing portion 68 of the cam pin 44 presses against the bearing surface 174 of the housing wear plate 52. Because the cover portion of the cam pin 44 is off-center from the housing portion 68 of the cam pin 44 and the housing wear plate 52 maintains the cam pin 44 in place relative to the housing 46, the cover 42 is forced to slide relative to the housing 46 into the closed or actuated position.

The movement of the cover 42 into the closed position is opposed by the sum of the forces required to insert each pin 58 into each contact 128. Because there are hundreds of contacts, the total force required may be quite large. This required actuation force results in a resultant force being placed on the cam pin 44. That resultant force is transmitted from the cam pin 44 to the bearing surface 174 of the housing wear plate 52, and in turn from the housing wear plate 52 to the load bearing feature 140 of the housing 46 via the interaction of the closing surface 170 of the housing wear plate 52 and the closing push surface 144 of the housing 46. The transmission of the resultant force at the load bearing feature 140 results in a moment about the solderball 130. The horizontal component of the moment arm is shown by closing moment arm 200. Similarly, sliding the cover to the open position from the closed position results in the transmission of a resultant force via the interaction of the opening surface 168 of the housing wear plate 52 and the opening push surface 142 of the load bearing feature 140 of the housing 46. Opening moment arm 202 is the horizontal component of the moment arm corresponding to the moment caused by moving the cover 42 to the open position. The moments caused by opening and closing the cover 42 can cause bowing along bowing direction D.

For the embodiment illustrated in FIG. 3, the opening moment arm 202 is the largest moment arm corresponding to the sliding of the cover 42 along direction C. Opening moment arm 202 is significantly less than either the opening moment arm 26 or the closing moment arm 28 of the prior art socket system 10 illustrated in FIG. 1. For example, for similarly sized sockets, the opening moment arm 202 may be 6.86 mm, whereas the opening moment arm 26 may be 19.02 mm. Because the moment is directly proportional to the length of the moment arm, the socket system 40 will experience considerably less bowing than the prior art socket system 10. Also, because the transmission of the resultant forces has been moved away from the back of the socket assembly 40, there will be reduced cracking of the housing 46 caused by the forces involved with opening and closing the cover 46 compared to the prior art socket system 10.

While particular elements, embodiments and applications of the present invention have been shown and described, it will be understood, of course, that the invention is not limited thereto since modifications may be made by those skilled in the art, particularly in light of the foregoing teachings. For example, multiple load bearing features, or a load bearing feature of a different shape may be used. Also, the wear plate could include a load bearing feature that extends into the housing. It is therefore contemplated by the appended claims to cover such modifications as incorporate those features which come within the spirit and scope of the invention.

What is claimed is:

1. A socket assembly for receiving electronic packages, comprising:

a cover and a base having a contact array slidably engaging one another and movable between an open position and a closed position;

a cam member received by each of said cover and said base wherein rotation of said cam member actuates a sliding motion between said cover and said base;

a load bearing member mounted to one of said cover and said base, said load bearing member including an oblong raised element having an opening push surface and a closing push surface on respective opposite sides thereof; and a wear plate having an oblong slot that receives said oblong raised element and a cam reception hole that receives said cam member, said oblong raised element and said cam member being located at respective different distances from said contact array to reduce a resultant moment caused by said sliding movement between said cover and said base.

2. The socket assembly of claim 1 wherein said oblong raised element extends from a wear plate cavity formed in said base.

3. The socket assembly of claim 1 wherein said distance between said cam member and said contact array is greater than said distance between said oblong raised element and said contact array.

4. The socket assembly of claim 1 further comprising a keying feature extending from said base, said wear plate including a keying hole, said keying feature and said keying hole cooperating to properly align said wear plate relative to said base.

5. The socket assembly of claim 1 wherein said cam member includes a first portion received by one of said cover and said base and a second portion received by the other of said cover and said base, said first and second portions of said cam member being eccentric to one another.

6. A socket assembly for receiving electronic packages, comprising:

a housing including an array of contacts, said contacts mountable to a circuit board at a mounting feature, said housing including an oblong raised element having an opening push surface and a closing push surface on respective opposite sides thereof;

a cover slidably mounted to said housing and movable relative to said housing between an actuated position and a de-actuated position;

a cam pin received by said housing and said cover wherein rotation of said cam pin moves said cover between said actuated and de-actuated positions, said cam pin being located farther from said array of contacts than said opening and closing push surfaces; and a housing wear plate having a cam reception hole receiving said cam pin and an oblong slot receiving said oblong raised element, said housing wear plate transferring actuation forces from said cam pin to said opening and closing push surfaces during said movement of said cover relative to said housing.

7. The socket assembly of claim 6 wherein said oblong slot extends through said housing wear plate.

8. The socket assembly of claim 6 further comprising a cover wear plate, said cover receiving said cover wear plate, said cover wear plate including a cam reception hole having a bearing surface contacting said cam pin, said cover wear plate cooperating with said cam pin to transmit resultant forces from the movement of said cover between said actuated and de-actuated positions from said cover to said cam pin.

9. The socket assembly of claim 8 wherein said cam pin includes a cover portion and a housing portion, said cover portion being received by said cover wear plate said housing portion being received by said housing wear plate, said cover and housing portions of said cam pin being eccentric to one another.

10. The socket assembly of claim 6 wherein said housing includes a keying feature extending from said housing, and said housing wear plate includes a keying hole receiving said keying feature, said keying feature and said keying hole cooperating to properly align said housing wear plate relative to said housing.

11. A socket assembly for receiving electronic packages, comprising:

a housing including an array of contacts, said contacts mountable to a circuit board at a mounting feature, said housing including a housing wear plate cavity including an oblong raised element extending from said housing wear plate cavity, said oblong raised element having an opening push surface and a closing push surface on respective opposite sides thereof;

a cover slidably mounted to said housing and movable relative to said housing between an actuated position and a de-actuated position;

a cam pin received by said housing and said cover wherein rotation of said cam pin actuates said housing between said actuated and de-actuated positions, said cam pin being located farther from said mounting feature than said opening and closing push surfaces;

a cover wear plate received by said cover, said cover wear plate including a cam reception hole receiving said cam pin, said cover wear plate cooperating with said cam pin to transmit resultant forces from the movement of said cover between said actuated and de-actuated positions from said cover to said cam pin; and a housing wear plate being received by said housing wear plate cavity, said housing wear plate having a cam reception bole receiving said cam pin and an oblong slot receiving said oblong raised element, said oblong slot including an opening surface corresponding to said opening push surface and a closing surface corresponding to said closing push surface, said opening surface and said closing surface cooperating with said opening push surface and said closing push surface, respectively, to reduce a resultant moment caused by said sliding movement of said cover relative to said housing.

12. The socket assembly of claim 11 wherein said oblong slot extends through said housing wear plate.

13. The socket assembly of claim 11 wherein said cam pin includes a cover portion and a housing portion, said cover portion being received by said cover wear plate, said housing portion being received by said housing wear plate, said cover and housing portions of said cam pin being eccentric to one another.

14. The socket assembly of claim 11 wherein said housing includes a keying feature extending from said housing wear plate cavity, and said housing wear plate includes a keying hole receiving said keying feature, said keying feature and said keying hole cooperating to properly align said housing wear plate relative to said housing wear plate cavity.

* * * * *